US008747077B2

(12) United States Patent
Hinrichs et al.

(10) Patent No.: US 8,747,077 B2
(45) Date of Patent: Jun. 10, 2014

(54) RECIPROCATING PISTON MACHINE

(75) Inventors: Jan Hinrichs, Friedrichsdorf (DE); Tilo Schäfer, Daubach (DE)

(73) Assignee: ixetic MAC GmbH, Bad Homburg (DE)

( * ) Notice: Subject to any disclaimer, the term of this patent is extended or adjusted under 35 U.S.C. 154(b) by 168 days.

(21) Appl. No.: 12/864,735

(22) PCT Filed: Feb. 20, 2009

(86) PCT No.: PCT/EP2009/001222

§ 371 (c)(1),
(2), (4) Date: Jul. 27, 2010

(87) PCT Pub. No.: WO2009/103546

PCT Pub. Date: Aug. 27, 2009

(65) Prior Publication Data

US 2010/0316510 A1 Dec. 16, 2010

(30) Foreign Application Priority Data

Feb. 21, 2008 (DE) ..... 10 2008 011 486

(51) Int. Cl.
*F04B 1/12* (2006.01)

(52) U.S. Cl.
CPC .. *F04B 1/128* (2013.01); *F04B 1/12* (2013.01)
USPC ..... 417/269; 92/12.2; 92/70

(58) Field of Classification Search
CPC ..... F04B 1/128; F04B 1/12
USPC ..... 417/222.1, 222.2, 269, 231, 364, 374; 92/12.2, 12.13, 70, 131
See application file for complete search history.

(56) References Cited

U.S. PATENT DOCUMENTS

| | | | | |
|---|---|---|---|---|
| 5,336,056 | A * | 8/1994 | Kimura et al. | 417/222.1 |
| 6,164,252 | A * | 12/2000 | Kuhn et al. | 123/56.3 |
| 6,705,841 | B2 * | 3/2004 | Pawelski et al. | 417/222.1 |
| 6,923,626 | B2 * | 8/2005 | Ota et al. | 417/222.2 |
| 2001/0028851 | A1 * | 10/2001 | Ota et al. | 417/269 |

(Continued)

FOREIGN PATENT DOCUMENTS

| | | |
|---|---|---|
| DE | 102004041645 | 3/2006 |
| JP | 2003113778 A | 4/2003 |
| JP | 2006144966 A | 6/2006 |

(Continued)

OTHER PUBLICATIONS

International Preliminary Report on Patentability and Written Opinion of the International Searching Authority for International Application No. PCT/EP2009/001222, dated Sep. 7, 2010.
First Office Action regarding Japan Application No. 2010547113 mailed Apr. 16, 2013. Translation provided by Suzuye & Suzuye.

*Primary Examiner* — Christopher Bobish
(74) *Attorney, Agent, or Firm* — Harness, Dickey & Pierce, P.L.C.

(57) ABSTRACT

A reciprocating piston machine includes a drive shaft having a central axis, a driving element rigidly connected to the drive shaft and extending essentially perpendicular to the central axis, a guide sleeve enclosing the drive shaft and axially displaceable thereon, and a spring element for applying a force to the guide sleeve and which on the one hand is supported on the guide sleeve and which on the other hand introduces forces into the drive shaft. Forces from the spring element are indirectly introduced into the drive shaft.

13 Claims, 1 Drawing Sheet

(56) References Cited

U.S. PATENT DOCUMENTS

| | | | | |
|---|---|---|---|---|
| 2003/0026708 | A1 | 2/2003 | Ota et al. | |
| 2003/0165389 | A1 | 9/2003 | Pawelski et al. | |
| 2004/0120830 | A1 | 6/2004 | Casar et al. | |
| 2006/0285981 | A1 * | 12/2006 | Theodore, Jr. | 417/269 |
| 2008/0304784 | A1 | 12/2008 | Inoue | |

FOREIGN PATENT DOCUMENTS

| | | | |
|---|---|---|---|
| WO | WO-99/24715 | A | 5/1999 |
| WO | WO-02/093010 | A | 11/2002 |

* cited by examiner

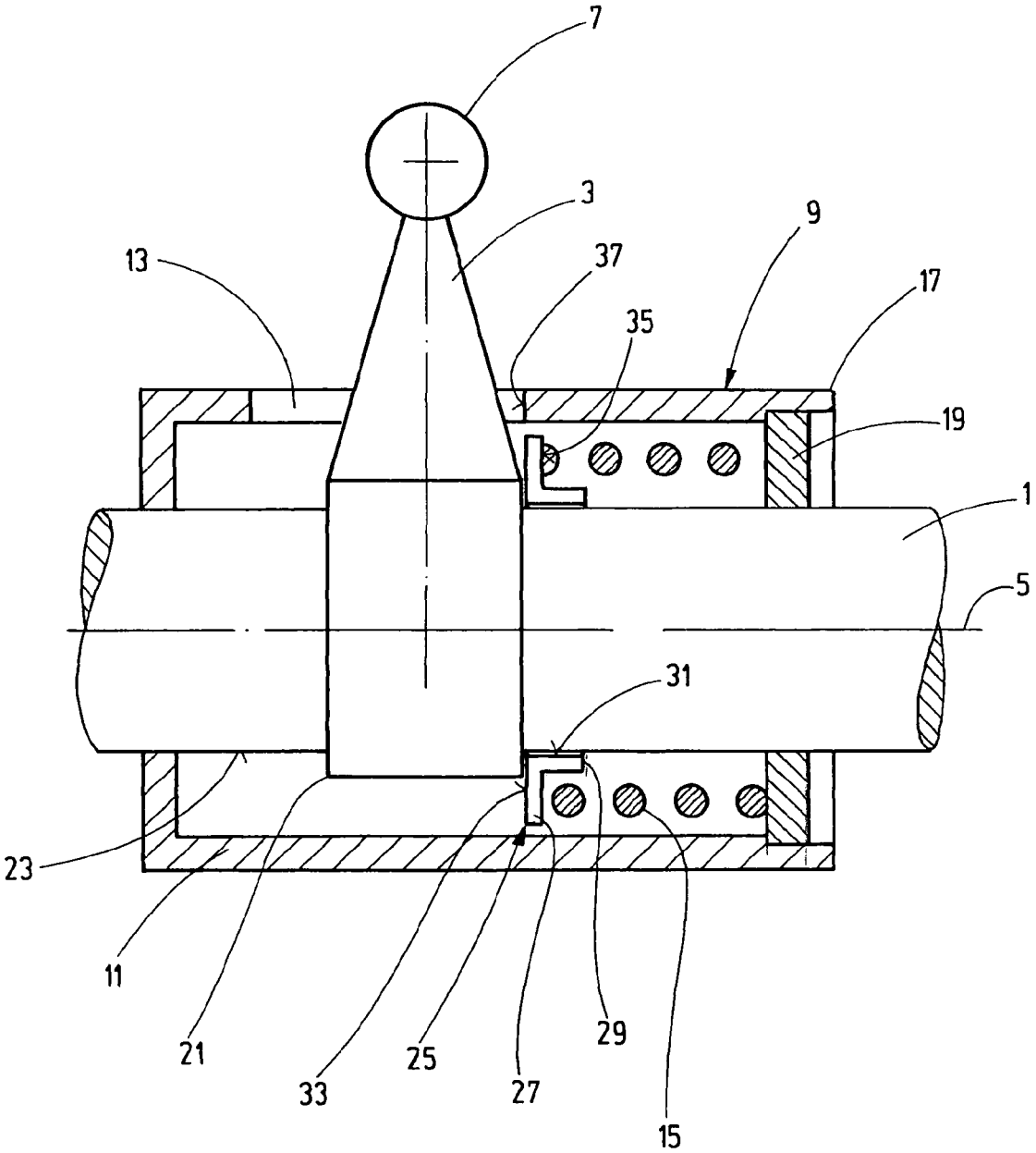
7
3
9
13
37
17
35
19
1
5
31
23
11
21
33
25
27
29
15

RECIPROCATING PISTON MACHINE

CROSS REFERENCE TO RELATED APPLICATIONS

This application is a 371 U.S. National Stage of International Application No. PCT/EP2009/001222, filed Feb. 20, 2009. This application claims the benefit of German Patent Application No. DE 102008011486.3, filed Feb. 21, 2008. The disclosures of the above applications are incorporated herein by reference.

FIELD

The invention relates to a reciprocating piston machine, in particular for motor vehicles, according to the preamble of claim 1.

BACKGROUND

Reciprocating piston machines of this type are known (U.S. Pat. No. 6,705,841 B2), and are used in particular in motor vehicles as coolant compressors for cooling the interior of the vehicle. They include a housing, a drive shaft, and a swivel element situated in the housing which defines a variable swivel angle with respect to a plane perpendicular to the drive shaft, the swivel element being articulatedly connected to a driving element. The driving element is connected to the drive shaft in a rotationally fixed manner, so that a rotation of the drive shaft also results in a rotation of the driving element and of the swivel element connected thereto, about the axis of the drive shaft. Such a reciprocating piston machine is provided with at least one piston which is movably supported in a cylinder preferably extending parallel to the drive shaft and which cooperates with the swivel element in such a way that a rotation of the swivel element results in an axial lifting motion of the piston. The piston stroke is a function of the swivel angle, i.e., the angle defined by the swivel element and a plane extending perpendicular to the central axis of the drive shaft. This swivel angle is variable due to the fact that the swivel element is articulatedly connected to the driving element. The drive shaft is coupled, for example, to the engine of a motor vehicle; this means that the rotational speed of the reciprocating piston machine depends directly on the engine speed. A variation of the swivel angle of the swivel element, and thus of the piston stroke of the reciprocating piston machine, is used to allow adjustment of the delivery volume, i.e., the output, of the reciprocating piston machine, independently of the rotational speed. In particular it may be desirable to achieve a constant delivery output which is independent of the engine speed. On the other hand, it is also possible that at constant engine speed the delivery volume of the reciprocating piston machine is to be adjusted to a changed output requirement. To allow the swivel angle to be varied, the swivel element is connected, via two bearing pins oppositely situated on the same axis, to a guide sleeve which is supported so as to be axially displaceable on the drive shaft. A spring element acts on the guide sleeve with a force which pushes the swivel element into a starting position in which the swivel element is essentially perpendicular to the drive shaft. To allow a delivery output to be achievable at all when the reciprocating piston machine is started, a stop element is provided which causes the swivel element to assume a minimum angle with respect to the plane perpendicular to the central axis of the drive shaft when the engine of the motor vehicle is at a standstill, and upon startup a minimum piston stroke is present which is sufficient to build up the pressure necessary for further control of the swivel angle. In reciprocating piston machines of this type, the spring element is supported on a step of the drive shaft, for which purpose the drive shaft is designed so that its diameter is not constant over its axial extension. In such cases, the drive shaft is often provided with a larger diameter in the region of the driving element to allow absorption of the forces which occur in the transmission of the rotary motion of the drive shaft to the driving element and the swivel element. The diameter of the shaft may then be reduced in other regions of the axial extension of the drive shaft. Such a design of the drive shaft has the disadvantage that it is expensive and time-consuming to manufacture.

SUMMARY

The object of the invention, therefore, is to provide a reciprocating piston machine which does not have this disadvantage, and which includes a drive shaft which is simple and economical to manufacture.

This object is achieved by a reciprocating piston machine having the features stated in claim 1. The reciprocating piston machine has a drive shaft, a driving element which is rigidly connected to the drive shaft, and a guide sleeve which encloses the drive shaft, as well as a spring element which on the one hand is supported on the guide sleeve and which on the other hand introduces forces into the drive shaft. The reciprocating piston machine is characterized in that the forces from the spring element are indirectly introduced into the drive shaft. In this manner it is possible to manufacture the drive shaft with a constant diameter along its axial extension in this region, and to dispense with a step. At the same time, the manufacture of the drive shaft is thus simple and economical.

One preferred exemplary embodiment of the reciprocating piston machine is characterized in that the forces from the spring element are introduced into the drive shaft via the driving element, and thus in a manner which allows a very simple design of the machine.

A further preferred exemplary embodiment of the reciprocating piston machine is characterized by a support element which absorbs the force from the spring element. Thus, it is not absolutely necessary to introduce the forces from the spring element directly into the driving element.

A reciprocating piston machine is particularly preferred which is characterized in that the support element is displaceably supported on the drive shaft.

In another preferred exemplary embodiment of the reciprocating piston machine, it is provided that the support element is designed in one piece with the driving element.

Also preferred is a reciprocating piston machine which is characterized in that the support element has an essentially L-shaped cross section. The spring element is supported on one leg of the support element, while the other leg encloses the drive shaft.

Also preferred is a reciprocating piston machine which is characterized in that the support element has a support surface by means of which the support element is supported on the driving element. The driving element absorbs the elastic forces produced by the spring element.

Also preferred is a reciprocating piston machine which is characterized in that the support element has a further support surface on which the spring element is supported. This support surface may be provided, for example, on one of the two legs of the L-shaped support element.

In another preferred reciprocating piston machine it is provided that the support element has a contact surface by means of which the support element lies against the drive shaft. This contact surface may also be provided on another leg of the L-shaped cross section.

Also preferred is a reciprocating piston machine which is characterized in that the support element is designed as a disk. This simplifies manufacture of the support element.

Also preferred is a reciprocating piston machine which is characterized in that the spring element is situated within the guide sleeve. This has the advantage that a very compact design may be achieved.

Also preferred is a reciprocating piston machine which is characterized in that a disk is provided which is situated on one end of the guide sleeve. This disk is used to close off the guide sleeve, and at the same allows elements such as the spring element and optionally the support element to be introduced into the guide sleeve. To achieve this, such a disk may be provided on at least one end of the guide sleeve. Of course, such a disk may also be provided on both ends of the guide sleeve. The disk forms a lid or cover for the guide sleeve, and together with the guide sleeve is axially displaceable on the drive shaft.

A reciprocating piston machine is also particularly preferred which is characterized in that the spring element is supported on the disk on the side of the spring element facing away from the support element.

BRIEF DESCRIPTION OF THE DRAWINGS

The invention is explained in greater detail below with reference to the drawing. The single FIGURE shows a section of a reciprocating piston machine.

DETAILED DESCRIPTION

As shown in the FIGURE provided as a schematic diagram, the reciprocating piston machine includes a drive shaft 1 and a driving element 3 rigidly connected thereto. The driving element is oriented essentially perpendicular to the central axis 5 of the drive shaft 1, and has a coupling region 7, shown here with a spherical design, via which the driving element 3 cooperates with a swivel element of the reciprocating piston machine, not illustrated here, which generally has a ring-shaped design.

The FIGURE also shows a guide sleeve 9 which encloses the drive shaft 1 and which is oriented essentially coaxial to the central axis 5. The circumferential wall 11 of the guide sleeve 9 has an oblong hole 13 which extends essentially parallel to the central axis 5, and which allows axial displacement of the guide sleeve 9 on the drive shaft 1. The lateral edges of the oblong hole 13 may act on the one hand as a guide and lie against the driving element, and on the other hand as a stop which limits the maximum axial displaceability of the guide sleeve 9 on the drive shaft 1.

At least one bearing pin (not illustrated) to which the swivel element is pivotably attached is mounted on the guide sleeve 9. The at least one bearing pin extends at an angle or perpendicular to the driving element 3, so that the swivel axis of the swivel element extends at an angle or perpendicular to the image plane of the illustrated FIGURE. Two oppositely situated bearing pins are preferably provided for stable bearing of the swivel element.

The guide sleeve 9 is acted on in a known manner by actuating forces, and is thus displaced on the drive shaft 1 in order to swivel the swivel element (not illustrated) to a greater or lesser degree with respect to a plane which is perpendicular to the central axis 5 of the drive shaft 1.

The guide sleeve 9 is displaced in opposition to the force of a spring element 15, which in this case is designed as a coil spring and encloses the drive shaft 1. It is apparent from the FIGURE that the spring element is located completely inside the guide sleeve 9.

The spring element 15 is supported on one end of the guide sleeve 9. At this location, at the end 17 of the guide sleeve 9 facing away from the driving element a disk 19 is provided which is fixedly connected to the guide sleeve 9 and which is used as an abutment for the spring element 15 and as a cover for the guide sleeve.

At the other end, i.e., at its end facing away from the disk 19, the spring element 15 introduces forces into the drive shaft 1. It is apparent from the FIGURE that these forces are indirectly introduced into the drive shaft. Compared to the prior art, this results in the following:

Drive shafts of known reciprocating piston machines have regions with different outer diameters, so that a step is formed with which a spring element of the type described here is able to engage. To avoid such a step, which increases the manufacturing costs for the reciprocating piston machine, it is provided herein that the forces from the spring element 15 are introduced into the driving element 3. In the present case, the driving element is long enough so that it passes through the drive shaft 1, and with its end 21 opposite from the coupling region 7 projects beyond the circumferential surface 23 of the drive shaft 1. Thus, forces introduced by the spring element 15 into the drive shaft 1 may be introduced into the driving element 3 at two locations: into the end 21 which projects beyond the circumferential surface 23, and into the region of the driving element 3 which extends from the drive shaft 1 to the coupling region 7.

It is clear that a pin which passes through the drive shaft 1 may also be inserted into the drive shaft so that forces may be indirectly introduced by the spring element 15 into the drive shaft 1. A pin may be selected which is longer than the diameter of the drive shaft 1. However, multiple shorter pins which are distributed over the circumferential surface may also be provided which are inserted into the drive shaft and are anchored at that location. These pins then preferably lie on a circumferential line which is situated in a plane perpendicular to the central axis 5 of the drive shaft 1.

However, the embodiment illustrated here, in which the forces from the spring element 15 are introduced into the drive shaft via the driving element 3, is preferred.

In the exemplary embodiment illustrated in the FIGURE, a support element 25 is provided between the end of the spring element 15 facing away from the disk 19 and the driving pin 3. The support element absorbs the forces emanating from the spring element 15, and preferably has a ring-shaped design so that introduction of forces into the driving element 3 only at certain points, and thus overloading of the spring element 15, is avoided.

The support element 25 has an L-shaped design as viewed in the cross section, and has a first leg 27 which is oriented essentially perpendicular to the central axis 5, as well as a second leg 29 which annularly encloses the drive shaft 1, the central axis of the ring formed by the leg 29 coinciding with the central axis 5 of the drive shaft 1.

The ring formed by the second leg 29 of the support element 25 has an outer diameter which is smaller than the inner diameter of the spring element 15, which in this case is designed as a coil spring. The spring element thus extends beyond the leg 29 of the support element 25. The inner side of the leg 29 facing the drive shaft 1 is used here as a contact surface 31. The support element 25 is designed in such a way that it is displaceable on the drive shaft 1 in the direction of the central axis 5.

The first leg 27 of the support element has a support surface 33, facing away from the spring element 15, by means of which the support element 25 lies against the driving element 3.

The leg 27 of the support element has a further support surface 35, facing the spring element 15, by means of which the support element 25 lies against the spring element 15.

It is clear from the explanation that the support element 25 may also be designed as a simple disk whose thickness is selected so that the spring element 15 lies against a side surface which faces away from the driving element 3. Lastly, the support element 25 may also be designed as a ring and provided with at least one recess which passes through the wall of the ring, and through which the driving element 3 projects and is fastenable in the drive shaft 1. In this case as well, the spring element 15 may be supported on a side surface of the sleeve-shaped support element 25 and may indirectly introduce forces into the drive shaft 1. It is also possible to design the support element 25 and the driving element 3 as one piece.

In the functional position of the sleeve 9 illustrated in the FIGURE, the sleeve is practically in its position displaced farthest to the left, due to the fact that the lateral border edge 37 to the right of the driving pin 3 almost abuts against same. In this functional position, the swivel element (not illustrated) has assumed a position which causes a full stroke of at least one piston of the reciprocating piston machine. If the guide sleeve 9 is displaced in the opposite direction all the way to the right, the element assumes a position which corresponds to the starting position, or is selected when a minimum lift of the at least one piston is to be produced during operation of the reciprocating piston machine.

A first further spring element may cooperate with the spring element 15 illustrated in the FIGURE in order to improve the starting characteristics of the reciprocating piston pump. A second further spring element may be selected so that during operation of the reciprocating piston machine the swivel element swivels in such a way that it assumes a minimum swivel angle when the pump is at a standstill to enable the reciprocating piston machine to start.

LIST OF REFERENCE NUMERALS

1 Drive shaft
3 Driving element
5 Center axis
7 Coupling region
9 Guide sleeve
11 Circumferential wall
13 Oblong hole
15 Spring element
17 End
19 Disk
21 End
23 Circumferential surface
25 Support element
27 Leg
29 Leg
31 Contact surface
33 Support surface
35 Support surface
37 Lateral border edge

The invention claimed is:

1. A reciprocating piston machine for a motor vehicle, comprising a drive shaft having a central axis;

a driving element rigidly connected to the drive shaft and extending essentially perpendicular to the central axis;

a guide sleeve enclosing the drive shaft and axially displaceable thereon;

a spring element situated within the guide sleeve acting on the guide sleeve with a force, the spring element supported on the guide sleeve, the spring element introducing forces into the drive shaft through the driving element; and a support element in a form of a disk for absorbing forces from the spring element, the disk having an outer diameter abutting an inner diameter of the guide sleeve.

2. A reciprocating piston machine for a motor vehicle, comprising a drive shaft having a central axis;

a driving element rigidly connected to the drive shaft and extending essentially perpendicular to the central axis;

a guide sleeve enclosing the drive shaft and axially displaceable thereon; and a spring element acting on the guide sleeve with a force, the spring element supported on the guide sleeve, the spring element indirectly introducing forces into the drive shaft; a support element which absorbs the force from the spring element; and a disk situated on one end of the guide sleeve;

wherein the spring element is situated within the guide sleeve;

wherein the forces from the spring element are introduced into the drive shaft via the driving element, and wherein the disk has an outer diameter abutting an inner diameter of the guide sleeve.

3. The reciprocating piston machine according to claim 2, wherein the support element and the driving element are designed as one piece.

4. The reciprocating piston machine according to claim 2, wherein the support element has an essentially L-shaped cross section.

5. The reciprocating piston machine according to claim 2, wherein the support element has a first support surface for supporting the support element on the driving element.

6. The reciprocating piston machine according to claim 5, wherein the support element has a second support surface on which the spring element is supported.

7. The reciprocating piston machine according to claim 2, wherein the support element has a contact surface abutting the drive shaft.

8. The reciprocating piston machine according to claim 2, wherein the support element is a disk.

9. The reciprocating piston machine according to claim 2, wherein the spring element is supported on the disk on a side of the spring element oppositely situated from the support element.

10. The reciprocating piston machine according to claim 2, wherein the support element is axially displaceable on the drive shaft.

11. The reciprocating piston machine of claim 2, wherein at least one bearing pin is mounted on the guide sleeve to which a swivel element is pivotably attached.

12. The reciprocating piston machine of claim 2, wherein the guide sleeve defines a cavity enclosed by an end wall, the disk and a sidewall extending therebetween, the spring element disposed in the cavity, the driving element extending from the cavity through the opening in the sidewall.

13. A reciprocating piston machine for a motor vehicle comprising:

a guide sleeve defining a cavity enclosed by a first end wall, a second end wall and a sidewall extending therebetween;

a drive shaft having a central axis passing through holes in the first and second end walls and through the cavity;

a driving element rigidly connected to the drive shaft and extending essentially perpendicular to the central axis, the driving element disposed in the cavity and extending through an opening in the sidewall;

a spring element disposed in the cavity and acting on the guide sleeve with a force, the spring element supported on the guide sleeve, the spring element indirectly introducing forces into the drive shaft through a driving element; and a support element in a form of a disk for absorbing forces from the spring element, the disk having an outer diameter abutting an inner diameter of the guide sleeve.

* * * * *